US009653022B2

(12) United States Patent
Wu et al.

(10) Patent No.: US 9,653,022 B2
(45) Date of Patent: May 16, 2017

(54) PIXEL CIRCUIT OF ORGANIC LIGHT-EMITTING DISPLAY AND METHOD OF DRIVING THE SAME, AND ORGANIC LIGHT-EMITTING DISPLAY

(71) Applicants: Shanghai Tianma AM-OLED Co., Ltd., Shanghai (CN); Tianma Micro-Electronics Co., Ltd., Shenzhen (CN)

(72) Inventors: Tong Wu, Shanghai (CN); Dong Qian, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 105 days.

(21) Appl. No.: 14/708,025

(22) Filed: May 8, 2015

(65) Prior Publication Data

US 2016/0140904 A1 May 19, 2016

(30) Foreign Application Priority Data

Nov. 19, 2014 (CN) ..... 2014 1 0664358

(51) Int. Cl.
*G09G 3/30* (2006.01)
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC .. G09G 3/30; G09G 3/36; G09G 3/34; G09G 3/32; G09G 5/00; G06F 3/038
See application file for complete search history.

(56) References Cited

U.S. PATENT DOCUMENTS 6,937,215 B2 * 8/2005 Lo ..... G09G 3/3233 345/76
7,872,620 B2 * 1/2011 Han ..... G09G 3/3258 345/82

(Continued)

FOREIGN PATENT DOCUMENTS

CN 102708790 A 10/2012
CN 103137071 A 6/2013

(Continued)

*Primary Examiner* — Pegeman Karimi
(74) *Attorney, Agent, or Firm* — Anova Law Group, PLLC

(57) ABSTRACT

A pixel circuit of an organic light-emitting display and a method of driving the same, and an organic light-emitting display are disclosed. The pixel circuit includes at least a first thin film transistor, a second thin film transistor, a third thin film transistor, a fourth thin film transistor, a fifth thin film transistor, a first capacitor, and a light-emitting diode. The pixel circuit and the method for driving the same enable a gate voltage and a source voltage of the first thin film transistor to be coupled and maintained in a control signal write phase and also compensate for a threshold voltage drift of the first thin film transistor so as to address the problem in prior art of non-uniform light emission by the OLED due to the threshold voltage drift of the drive transistor or the instable voltage across the gate and the source of the drive transistor.

20 Claims, 15 Drawing Sheets

(52) U.S. Cl.
CPC ..... *G09G 2300/0852* (2013.01); *G09G 2300/0861* (2013.01); *G09G 2310/0262* (2013.01); *G09G 2320/045* (2013.01)

(56) References Cited

U.S. PATENT DOCUMENTS

| | | | | |
|---|---|---|---|---|
| 8,564,512 | B2 | 10/2013 | Chung | |
| 8,665,254 | B2 | 3/2014 | Chung et al. | |
| 9,001,113 | B2 * | 4/2015 | Guo | G09G 3/3233 345/214 |
| 9,095,031 | B2 * | 7/2015 | Tan | H05B 33/0896 |
| 2006/0256057 | A1 | 11/2006 | Han et al. | |
| 2008/0297449 | A1 * | 12/2008 | Yamashita | G09G 3/3233 345/76 |

FOREIGN PATENT DOCUMENTS

| | | | |
|---|---|---|---|
| JP | 2006119180 | A | 5/2006 |
| TW | 200509032 | B | 3/2005 |

* cited by examiner

PIXEL CIRCUIT OF ORGANIC LIGHT-EMITTING DISPLAY AND METHOD OF DRIVING THE SAME, AND ORGANIC LIGHT-EMITTING DISPLAY

CROSS-REFERENCES TO RELATED APPLICATIONS

This application claims the benefit of priority to Chinese Patent Application No. 201410664358.4, filed with the Chinese Patent Office on Nov. 19, 2014 and entitled "PIXEL CIRCUIT OF ORGANIC LIGHT-EMITTING DISPLAY AND METHOD OF DRIVING THE SAME, AND ORGANIC LIGHT-EMITTING DISPLAY", the content of which is incorporated herein by reference in its entirety.

FIELD OF THE INVENTION

The present invention relates to the field of organic light-emitting displays, and particularly to a pixel circuit of an organic light-emitting display, a method of driving the same, and an organic light-emitting display.

BACKGROUND OF THE INVENTION

In the existing pixel circuit, an N-type thin film transistor is typically used as a drive transistor of a light-emitting diode, but a drift in characteristic voltage (e.g., threshold voltage) of the drive transistor tends to result in a deviation in display brightness of a panel, a failure to write a data signal and other abnormal display phenomena. With a 2T1C pixel circuit illustrated in FIG. 1, in a signal write phase, a SCAN2 signal is applied to a gate of an MOS transistor M2 to turn on transistor M2, and after transistor M2 is turned on, a DATA signal is provided to a node N1 to charge a storage capacitor Cst while turning on a drive transistor M1, which generates a drive current to cause an Organic Light-Emitting Diode (OLED) between a first power supply PVDD and a second power supply PVEE to emit light. The drive transistor M1 in the pixel circuit as illustrated in FIG. 1 provides the organic light-emitting diode with the drive current $I_{OLED}$ as represented in Equation 1:

$$I_{OLED} = \frac{1}{2}\mu C_{OX}\frac{W}{L}(V_{GS} - V_{TH})^2; \quad \text{(Equation 1)}$$

In Equation 1, μ represents carrier mobility, $C_{OX}$ represents a gate oxide capacitance per unit area of the drive transistor M1, L represents a channel length of the drive transistor M1, W represents a gate width of the drive transistor M1, $V_{GS}$ represents gate-source voltage of the drive transistor M1, and $V_{TH}$ represents threshold voltage of the drive transistor M1. As is apparent from Equation 1, the value of the drive current $I_{OLED}$ is dependent upon the gate-source voltage $V_{GS}$ and the threshold voltage $V_{TH}$ of the drive transistor M1. When the thin film transistor is turned on for a long period of time, the threshold voltage of the thin film transistor tends to vary, which is referred to as a threshold drift, and the threshold drift of the drive transistor may result in non-uniform brightness of light emission by the OLED. If there is instable voltage across the gate and the source of the drive transistor after the control signal is provided, the generated drive current may also be influenced thus resulting in non-uniform light emission by the OLED.

Thus, there is the problem in the prior art of non-uniform light emission by the OLED due to the threshold voltage drift of the drive transistor or the instable voltage across the gate and the source of the drive transistor.

BRIEF SUMMARY OF THE INVENTION

Embodiments of the invention provide a pixel circuit of an organic light-emitting display and a method of driving the same, and an organic light-emitting display so as to address the problem in the prior art of non-uniform light emission by an OLED due to a threshold voltage drift of a drive transistor or an instable voltage across a gate and a source of the drive transistor.

An embodiment of the invention provides a pixel circuit of an organic light-emitting display. The pixel circuit includes:

- a first thin film transistor, a second thin film transistor, a third thin film transistor, a fourth thin film transistor, a fifth thin film transistor, a first capacitor, and a light-emitting diode;
- a gate of the first thin film transistor is connected with a first electrode of the third thin film transistor, a first electrode of the first thin film transistor is connected with a second electrode of the fifth thin film transistor, and a second electrode of the first thin film transistor is connected with a first electrode of the second thin film transistor;
- a gate of the second thin film transistor is connected with a light emission control signal line, a second electrode of the second thin film transistor is connected with a cathode of the light-emitting diode, and an anode of the light-emitting diode is connected with a first power supply;
- a gate of the third thin film transistor is connected with a first signal line, and a second electrode of the third thin film transistor is connected with the first electrode of the second thin film transistor;
- a gate of the fourth thin film transistor is connected with the first signal line, a first electrode of the fourth thin film transistor is connected with the first electrode of the first thin film transistor and the second electrode of the fifth thin film transistor, and a second electrode of the fourth thin film transistor is connected with a data line;
- a gate of the fifth thin film transistor is connected with the light emission control signal line, and a first electrode of the fifth thin film transistor is connected with a second power supply; and
- the first capacitor is connected between the anode of the light-emitting diode and the gate of the first thin film transistor. With the pixel circuit, the gate voltage and the source voltage of the first thin film transistor can be coupled and maintained in the control signal write phase, and also the threshold voltage drift of the first thin film transistor can be compensated for.

When the first thin film transistor, the second thin film transistor, the third thin film transistor, the fourth thin film transistor, the fifth thin film transistor, and the sixth thin film transistor are N-type thin film transistors, the first signal line is a second scan line, the first electrodes are sources, and the second electrodes are drains, an embodiment of the invention further provides a method of driving the pixel circuit. The method includes:

- in a data write phase, applying a high level to the second scan line to turn on the third thin film transistor, the fourth thin film transistor, and the first thin film transistor; applying a low level to the light emission control signal line to turn off the second thin film transistor and the fifth thin film transistor; applying a high level on the data line so that a voltage of the first electrode of the first thin film transistor is a first voltage; and when the first thin film transistor is turned on, storing charge in the first capacitor starts until a gate voltage of the first thin film transistor drops to a second voltage and the first thin film transistor is turned off at this time, and after the first thin film transistor is turned off, maintaining the gate voltage of the first thin film transistor at the second voltage; and in a light emission phase, applying a low level to the second scan line to turn off the third thin film transistor and the fourth thin film transistor; applying a high level on the light emission control signal line to turn on the second thin film transistor and the fifth thin film transistor, and when the fifth thin film transistor is turned on, the voltage of the first electrode of the first thin film transistor is the voltage of the second power supply, and the gate voltage of the first thin film transistor is the second voltage, and the gate-source voltage of the first thin film transistor turns on the first thin film transistor, which generates a drive current to cause the light-emitting diode to emit light. In the embodiment above, the light emission control signal in the data write phase T1 turns off the second thin film transistor and the fifth thin film transistor, thus ensuring the OLED not to emit light temporarily before and after the threshold voltage of the first thin film transistor is compensated for so as to prevent insufficient darkness of the OLED being dimmed. In the embodiment above, in the data write phase, the scan signal turns on the third thin film transistor and the fourth thin film transistor so that during first thin film transistor from being turned on to being turned off, the gate voltage of the first thin film transistor is coupled and the threshold voltage thereof is captured and stored in the gate voltage, and the coupled gate voltage of the first thin film transistor (the sum of the first voltage and the threshold voltage of the first thin film transistor) is maintained due to the first capacitor. In the embodiment above, in the light emission phase, the second and fifth thin film transistors are turned on so that the threshold voltage of the first thin film transistor is captured in the gate-source voltage of the first thin film transistor (the first voltage+the threshold voltage of the first thin film transistor−the voltage of the second power supply), thus ensuring light emission by the $$OLED\left(I_{OLED} = \frac{1}{2}\mu C_{OX}\frac{W}{L}(V_{DATA} - V_{PVEE})^2\right)$$

to be independent of the threshold voltage of the drive transistor.

In the present embodiment, the voltage of the second electrode of the first thin film transistor can be reset, before the data is written, to thereby prevent the OLED from emitting light abnormally due to the threshold voltage drift arising from the drain voltage of the drive transistor M1 being at a high level for a long period of time.

When the third thin film transistor and the fourth thin film transistor are P-type thin film transistors, and all the other thin film transistors are N-type thin film transistors, the first signal line is the light emission control signal line, the first electrodes of the P-type thin film transistors are drains and the second electrodes thereof are sources, and the first electrodes of the N-type thin film transistors are sources and the second electrodes are drains, an embodiment of the invention further provides a method of driving the pixel circuit, the method including:

in a data write phase, applying a low level to the light emission control signal line to turn on the third thin film transistor, the fourth thin film transistor, and the first thin film transistor and turn off the second thin film transistor and the fifth thin film transistor; applying a high level on the data line so that there a voltage of the first electrode of the first thin film transistor is a first voltage; and when the first thin film transistor is turned on, the first capacitor starts to store charges until the gate voltage of the first thin film transistor drops to second voltage and the first thin film transistor is turned off at this time, and after the first thin film transistor is turned off, the gate voltage of the first thin film transistor is maintained at the second voltage; and in a light emission phase, applying a high level to the light emission control signal line to turn off the third thin film transistor and the fourth thin film transistor, and turn on the second thin film transistor and the fifth thin film transistor, and when the fifth thin film transistor is turned on, the voltage of the first electrode of the first thin film transistor is the voltage of the second power supply, and the gate voltage of the first thin film transistor is the second voltage, and the gate-source voltage of the first thin film transistor turns on the first thin film transistor, and drive current generated by the first thin film transistor being turned on drives the light-emitting diode to emit light.

In the embodiment described above, in the data write phase, the light emission control signal turns off the second thin film transistor and the fifth thin film transistor, thus ensuring the OLED not to emit light temporarily before and after the threshold voltage of the first thin film transistor is compensated for so as to prevent insufficient darkness of the OLED being dimmed. In the embodiment described above, in the data write phase, the light emission control signal turns on the P-type third thin film transistor and the P-type fourth thin film transistor so that the first thin film transistor from being turned on to being turned off, the gate voltage of the first thin film transistor is coupled and the threshold voltage thereof is captured and stored in the gate voltage, and the coupled gate voltage of the first thin film transistor (the sum of the first voltage and the threshold voltage of the first thin film transistor) is maintained due to the first capacitor. In the embodiment above, in the light emission phase, the second and fifth thin film transistors are turned on so that the threshold voltage of the first thin film transistor is captured in the gate-source voltage of the first thin film transistor (the first voltage+the threshold voltage of the first thin film transistor−the voltage of the second power supply), thus ensuring light emission by the OLED to be independent of the threshold voltage of the drive transistor.

When the first thin film transistor, the second thin film transistor, the third thin film transistor, the fourth thin film transistor, the fifth thin film transistor, and the sixth thin film transistor are N-type thin film transistors, the first signal line is a second scan line, the first electrodes are sources, and the second electrodes are drains, an embodiment of the invention further provides an organic light-emitting display including:

a scan drive unit, a data drive unit, a light emission drive unit, N+1 scan lines, M data lines DATA, and N light emission control signal lines; and an array of pixel circuits including the all-NMOS pixel circuits described above arranged in N rows by M columns, wherein:

in the array of pixel circuits, the gates of the third thin film transistors and the fourth thin film transistors of a n-th row of the pixel circuits are connected with a (n+1)-th scan line, the second electrodes of the fourth thin film transistors of the m-th column of the pixel circuits are connected with a m-th data line, and the gates of the second thin film transistors and the fifth thin film transistors of the n-th row of the pixel circuits are connected with a n-th light emission control signal line, wherein $1 \leq n \leq N$, and $1 \leq m \leq M$;

the scan drive unit is configured to provide respective scan lines with a scan signal;

the data drive unit is configured to provide respective data lines with a data signal; and the light emission drive unit is configured to provide respective light emission control signal lines with a light emission control signal.

In the embodiment above, the organic light-emitting display is characterized above to thereby ensure the all-NMOS pixel circuits to be driven normally so as to compensate for the threshold voltage drift of the first thin film transistor and to stabilize the gate voltage and the source voltage of the first thin film transistors being compensated.

When the third thin film transistor and the fourth thin film transistor are P-type thin film transistors, and all the other thin film transistors are N-type thin film transistors, the first signal line is the light emission control signal line, the first electrodes of the P-type thin film transistors are drains and the second electrodes thereof are sources, and the first electrodes of the N-type thin film transistors are sources and the second electrodes are drains, an embodiment of the invention further provides an organic light-emitting display including:

a scan drive unit, a data drive unit, a light emission drive unit, N scan lines, M data lines, and N light emission control signal lines; and an array of pixel circuits including the CMOS pixel circuits above in N rows by M columns, wherein:

in the array of pixel circuits, the gates of the third thin film transistors and the sixth thin film transistors of a n-th row of the pixel circuits are connected with a n-th light emission control signal line, the first electrodes of the sixth thin film transistors of a m-th column of the pixel circuits are connected with a m-th data line, and the gates of the second thin film transistors and the fifth thin film transistors of the n-th row of the pixel circuits are connected with the n-th light emission control signal line, wherein $1 \leq n \leq N$, and $1 \leq m \leq M$;

the scan drive unit is configured to provide respective scan lines with a scan signal;

the data drive unit is configured to provide respective data lines with a data signal; and the light emission drive unit is configured to provide respective light emission control signal lines with a light emission control signal.

In the embodiment above, the organic light-emitting display is characterized above to thereby ensure the CMOS pixel circuits to be driven normally so as to compensate for the threshold voltage drift of the first thin film transistors and to stabilize the gate voltage and the source voltage of the first thin film transistors being compensated.

BRIEF DESCRIPTION OF THE DRAWINGS

In order to make the technical solutions according to the embodiments of the invention or in the prior art more apparent, the drawings to be used in a description of the embodiments will be described below briefly, and apparently the drawings described below are only some of the embodiments of the invention, and those ordinarily skilled in the art can further derive other drawings without any inventive effort from these drawings in which.

DETAILED DESCRIPTION OF THE INVENTION

The present invention will now be described more fully herein after with reference to the accompanying drawings, in which preferred embodiments of the invention are shown. This invention may, however, be embodied in many different forms and should not be construed as limited by the embodiments set forth herein. Those of ordinary skill in the art will realize that the following description of the present invention is illustrative only and not in any way limiting. Other embodiments of the invention will readily suggest themselves to such skilled persons after a perusal of this disclosure.

In order to address the problem in the prior art of non-uniform light emission by an OLED, in order to compensate for a drift in threshold voltage of a drive transistor and control precisely the voltage across the gate and the source of the drive transistor, several pixel circuits are provided according to the embodiments of the invention, including a first pixel circuit which is an all-NMOS pixel circuit, and a second pixel circuit which is a CMOS pixel circuit, and an all-PMOS pixel circuit can also be derived from variants of these two pixel circuits without departing from the scope of the invention, and not all the variants of the pixel circuits will be listed here, although several of the pixel circuits will be described below in details.

First Embodiment

Figure 2:
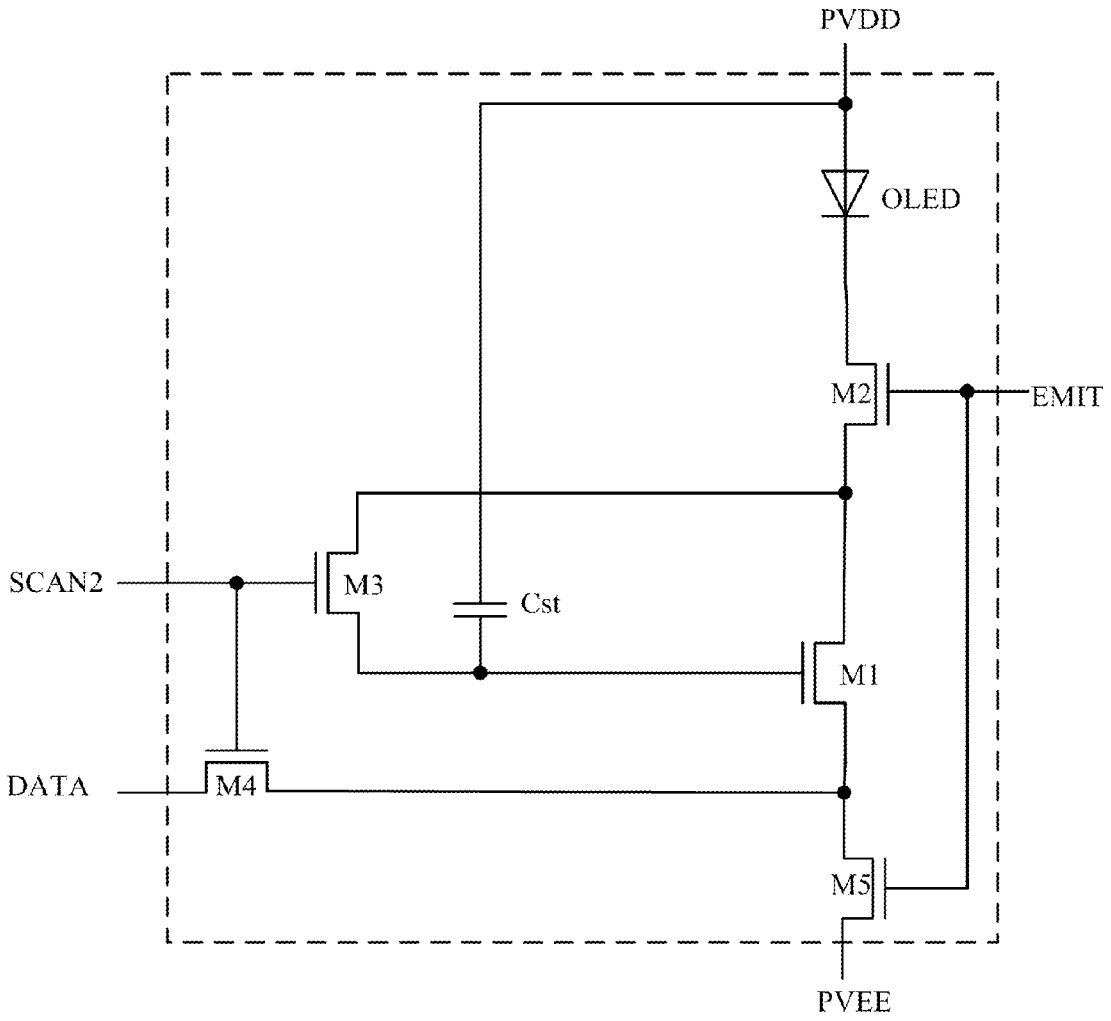
FIG. 2 illustrates a circuit diagram of an all-NMOS pixel circuit of an organic light-emitting display according to an embodiment of the invention.

FIG. 2 illustrates a circuit diagram of an all-NMOS pixel circuit of an organic light-emitting display according to an embodiment of the invention, which is an all-NMOS pixel circuit including a first thin film transistor M1, a second thin film transistor M2, a third thin film transistor M3, a fourth thin film transistor M4, a fifth thin film transistor M5, a first capacitor Cst which is a storage capacitor, and an Organic Light-Emitting Diode (OLED).

A gate of the first thin film transistor M1 is connected with a first electrode of the third thin film transistor M3, a first electrode of the first thin film transistor M1 is connected with a second electrode of the fifth thin film transistor M5, and a second electrode of the first thin film transistor M1 is connected with a first electrode of the second thin film transistor M2;

A gate of the second thin film transistor M2 is connected with a light emission control signal line EMIT, a second electrode of the second thin film transistor M2 is connected with a cathode of the Organic Light-Emitting Diode (OLED), and an anode of the Organic Light-Emitting Diode (OLED) is connected with a first power supply PVDD;

A gate of the third thin film transistor M3 is connected with a first signal line, and a second electrode of the third thin film transistor M3 is connected with the first electrode of the second thin film transistor M2;

A gate of the fourth thin film transistor M4 is connected with the first signal line, a first electrode of the fourth thin film transistor M4 is connected with the first electrode of the first thin film transistor M1 and the second electrode of the fifth thin film transistor M5, and a second electrode of the fourth thin film transistor M4 is connected with a data line DATA;

A gate of the fifth thin film transistor M5 is connected with the light emission control signal line EMIT, and a first electrode of the fifth thin film transistor M5 is connected with a second power supply; and The first capacitor Cst is connected between the anode of the Organic Light-Emitting Diode (OLED) and the gate of the first thin film transistor M1.

In the pixel circuit as illustrated in FIG. 2, the first power supply PVDD provides a voltage which is higher than the voltage provided by the second power supply PVEE. All the first to sixth thin film transistors are N-type thin film transistors, the first signal line is a second scan signal line SCAN2, the first electrodes are sources, and the second electrodes are drains. In addition to stabilize the gate voltage and the source voltage of the first thin film transistor and compensate threshold voltage of the first thin film transistor, the all-NMOS pixel circuit according to the embodiment of the invention can be fabricated in a simplified process while avoiding effectively an influence of a threshold voltage drift, which arises from the fabrication process, temperature and other factors, on a display effect thereof.

Figure 1:
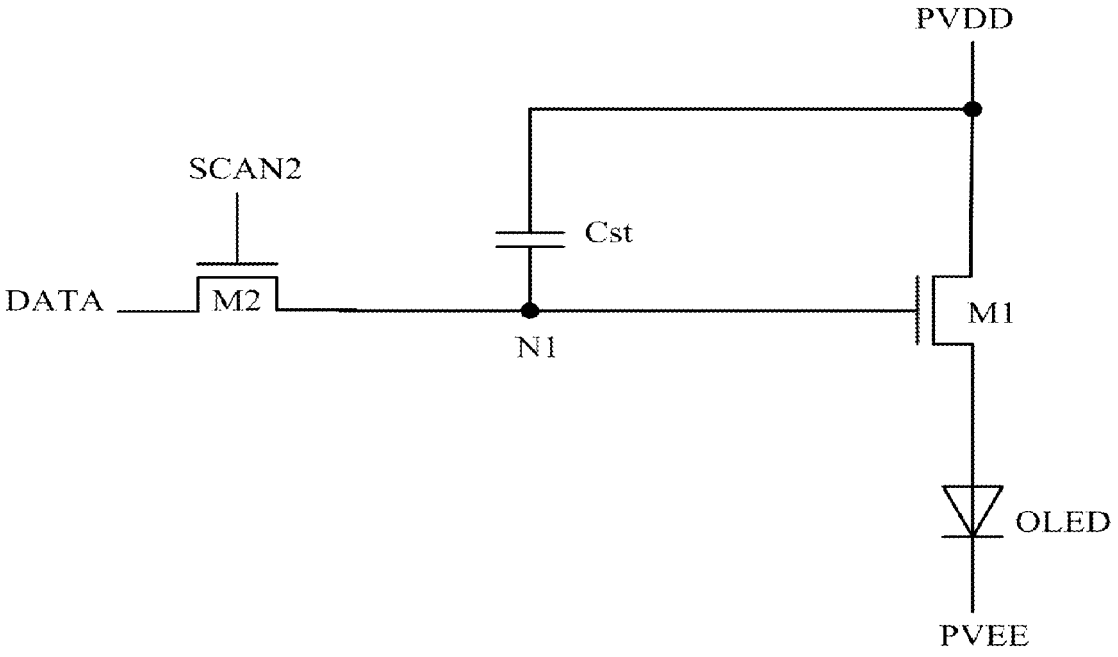
FIG. 1 (Prior Art)
FIG. 1 illustrates a circuit diagram of a pixel circuit in the prior art.

As compared with FIG. 1, in the pixel circuit as illustrated in FIG. 2 according to the embodiment of the invention, the Organic Light-Emitting Diode (OLED) is not disposed at the second power supply PVEE, but instead the anode of the Organic Light-Emitting Diode (OLED) is connected with the first power supply PVDD so that the source of the first thin film transistor is connected with the second power supply PVEE (through the fifth thin film transistor), thus defining the source voltage of the drive transistor M1 and preventing the gate-source voltage of the drive transistor M1 from being undefined.

Figure 3:
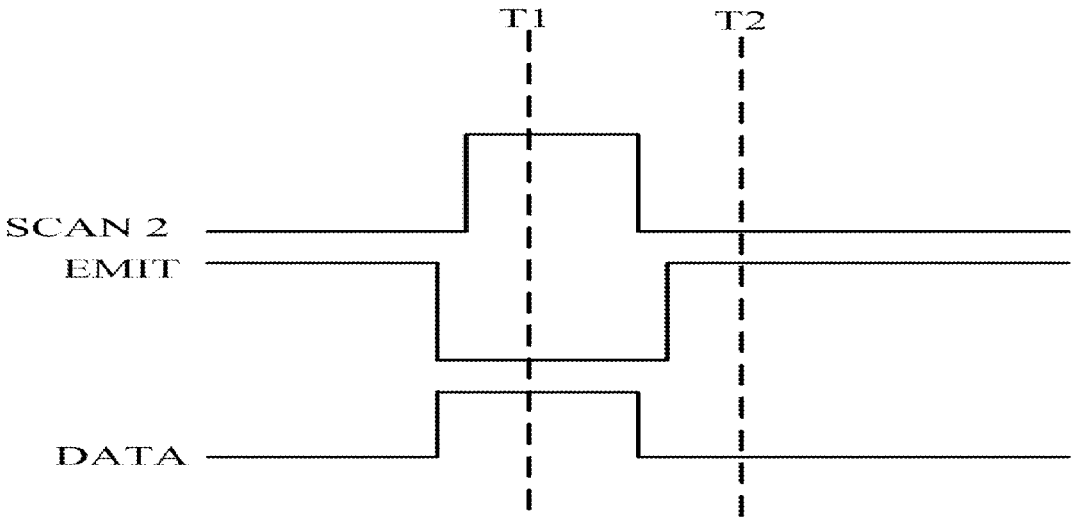
FIG. 3 illustrates a timing diagram of a signal input to the pixel circuit as illustrated in FIG. 2 according to an embodiment of the invention.

FIG. 3 illustrates a timing diagram of a signal input of the pixel circuit as illustrated in FIG. 2, in a data write phase T1, the second scan line SCAN2 is at a high level, the data line DATA is at a high level, and the light emission control signal line EMIT is at a low level; and in a light emission phase T2, the second scan line SCAN2 is at a low level, and the light emission control signal line EMIT is at a high level.

With the timing diagram illustrated in FIG. 3, a method of driving the pixel circuit as illustrated in FIG. 2 is as follows:

In the data write phase T1, a high level signal (alternatively referred to as "high level" hereinafter) is applied to the second scan line SCAN2 to turn on the third thin film transistor M3, the fourth thin film transistor M4, and the first thin film transistor M1, where the first thin film transistor M1 is turned on because before the high level is applied to the second scan line SCAN2, a temporary high-level signal of the light emission control signal line EMIT (as illustrated in FIG. 3) turns on the second thin film transistor M2, and the storage capacitor Cst maintains the drain of the first thin film transistor M1 at a high level, and after the high level is applied to the second scan line SCAN2 so that the third thin film transistor M3 is turned on, both the gate and the drain of the first thin film transistor M1 are at a high level so that the first thin film transistor M1 is turned on; the low level signal (alternatively referred to as "low level" hereinafter) is applied to the light emission control signal line EMIT to turn off the second thin film transistor M2 and the fifth thin film transistor M5; a high level is applied to the data line DATA so that the voltage of the first electrode of the first thin film transistor M1 is first voltage $V_{DATA}$; and the first thin film transistor M1 is turned on so that the first capacitor Cst starts to store charges, until the gate voltage of the first thin film transistor M1 drops to second voltage ($V_{DATA}+V_{TH}$), the first thin film transistor M1 is turned off at this time, and after the first thin film transistor M1 is turned off, the gate voltage of the first thin film transistor M1 is maintained at the second voltage ($V_{DATA}+V_{TH}$), $V_{DATA}$ represents high-level voltage applied to the data line DATA, and $V_{TH}$ represents the threshold voltage of the first thin film transistor M1.

In the light emission phase T2, a low level is applied to the second scan line SCAN2 so that the third thin film transistor M3 and the fourth thin film transistor M4 are turned off; a high level is applied to the light emission control signal line EMIT so that the second thin film transistor M2 and the fifth thin film transistor M5 are turned on, and the fifth thin film transistor M5 is turned on so that the voltage of the first electrode of the first thin film transistor M1 is the voltage of the second power supply PVEE, and the gate voltage of the first thin film transistor M1 is the second voltage ($V_{DATA}+V_{TH}$), and the gate-source voltage of the first thin film transistor ($V_{DATA}+V_{TH1}-$PVEE) turns on the first thin film transistor M1, and drive current generated by the first thin film transistor M1 being turned on drives the organic light-emitting diode to emit light, where the drive current can be calculated in Equation 2 of:

$$I_{OLED} = \frac{1}{2}\mu C_{OX}\frac{W}{L}(V_{GS} - V_{TH})^2 = \frac{1}{2}\mu C_{OX}\frac{W}{L}(V_{DATA} + V_{TH} - PVEE - V_{TH})^2 = \frac{1}{2}\mu C_{OX}\frac{W}{L}(V_{DATA} - V_{PVEE})^2 \quad \text{(Equation 2)}$$

In the embodiment above, in the data write phase T1, the scan signal turns off the second thin film transistor and the fifth thin film transistor, thus ensuring the OLED not to emit light temporarily before and after the threshold voltage of the first thin film transistor is compensated for so as to prevent insufficient darkness of the OLED being dimmed. In the data write phase T1, the scan signal turns on the third thin film transistor and the fourth thin film transistor so that during the first thin film transistor from being turned on to being turned off, the gate voltage of the first thin film transistor is coupled to the source of first thin film transistor and the threshold voltage thereof is captured and stored in the gate voltage, and the coupled gate voltage of the first thin film transistor (the sum of the first voltage and the threshold voltage of the first thin film transistor) is maintained due to the first capacitor. In the light emission phase T2, the second and fifth thin film transistors are turned on so that the threshold voltage of the first thin film transistor is captured in the gate-source voltage of the first thin film transistor (the first voltage+the threshold voltage of the first thin film transistor−the voltage of the second power supply), thus ensuring light emission by the $$OLED\left(I_{OLED} = \frac{1}{2}\mu C_{OX}\frac{W}{L}(V_{DATA} - V_{PVEE})^2\right)$$

to be independent of the threshold voltage of the first thin film transistor (i.e., drive transistor).

Figure 4:
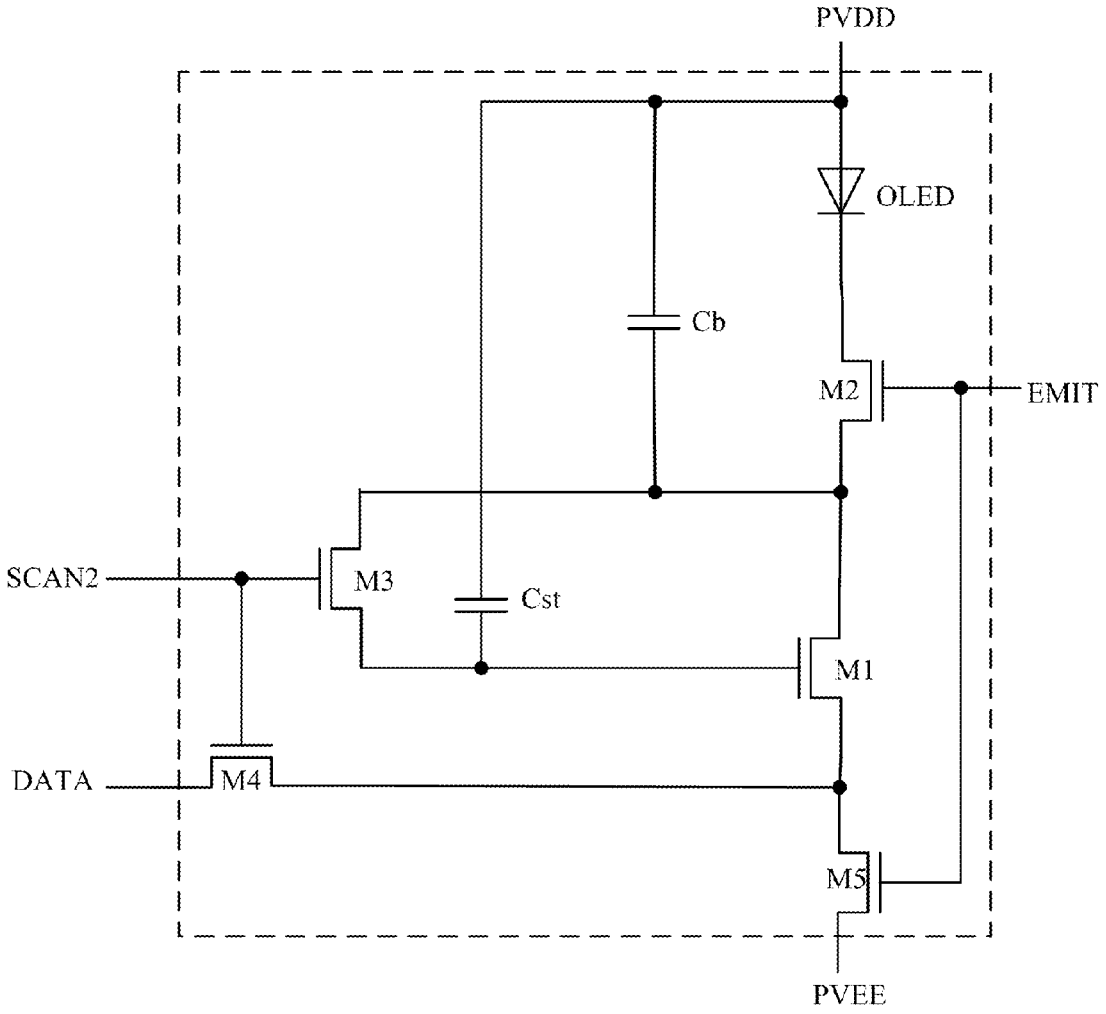
FIG. 4 illustrates a circuit diagram of an all-NMOS pixel circuit of an organic light-emitting display according to an embodiment of the invention.

In the present embodiment, the pixel circuit as illustrated in FIG. 2 can be further extended particularly as follows:

Preferably the pixel circuit as illustrated in FIG. 2 further includes a second capacitor Cb, as illustrated in FIG. 4, the second capacitor Cb is connected between the anode of the Organic Light-Emitting Diode (OLED) and the second electrode of the first thin film transistor M1, the second capacitor Cb is a charging capacitor; and the second capacitor can be added so that the threshold voltage of the drive transistor is captured in the data write phase T1, and the coupled gate voltage is maintained before the light emission phase T2.

Figure 5:
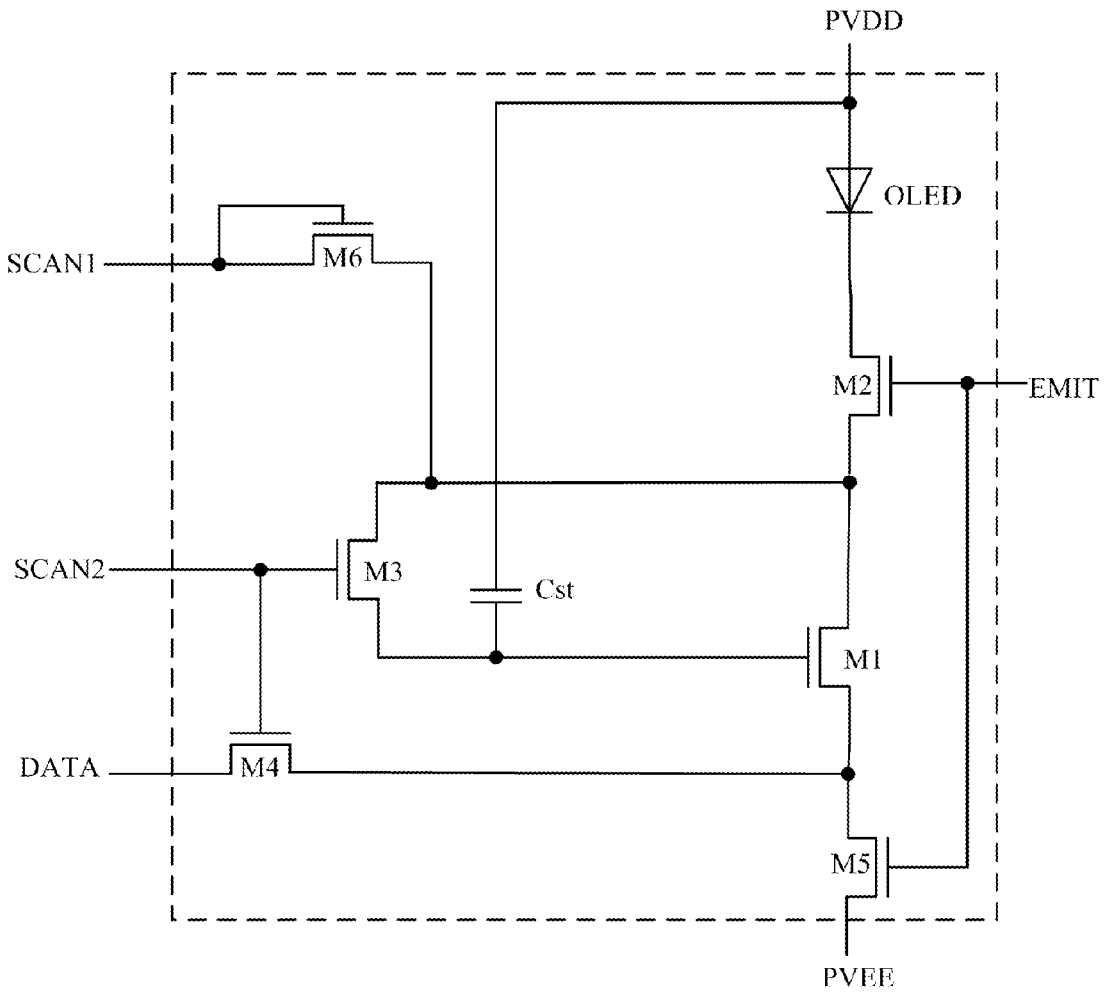
FIG. 5 illustrates a circuit diagram of an all-NMOS pixel circuit of an organic light-emitting display according to an embodiment of the invention.

Preferably the pixel circuit as illustrated in FIG. 2 further includes a first scan line SCAN1 and a sixth thin film transistor M6, and as illustrated in FIG. 5, both a gate and a second electrode of the sixth thin film transistor M6 are connected with the first scan line SCAN1, and a first electrode of the sixth thin film transistor M6 is connected with the second electrode of the first thin film transistor M1; and the first scan line and the sixth thin film transistor can be added so that the drain voltage of the drive transistor M1 can be reset before the signal is written, to thereby prevent the OLED from emitting light abnormally due to a threshold voltage drift arising from the drain voltage of the drive transistor M1 being at a high potential for a long period of time.

Figure 6:
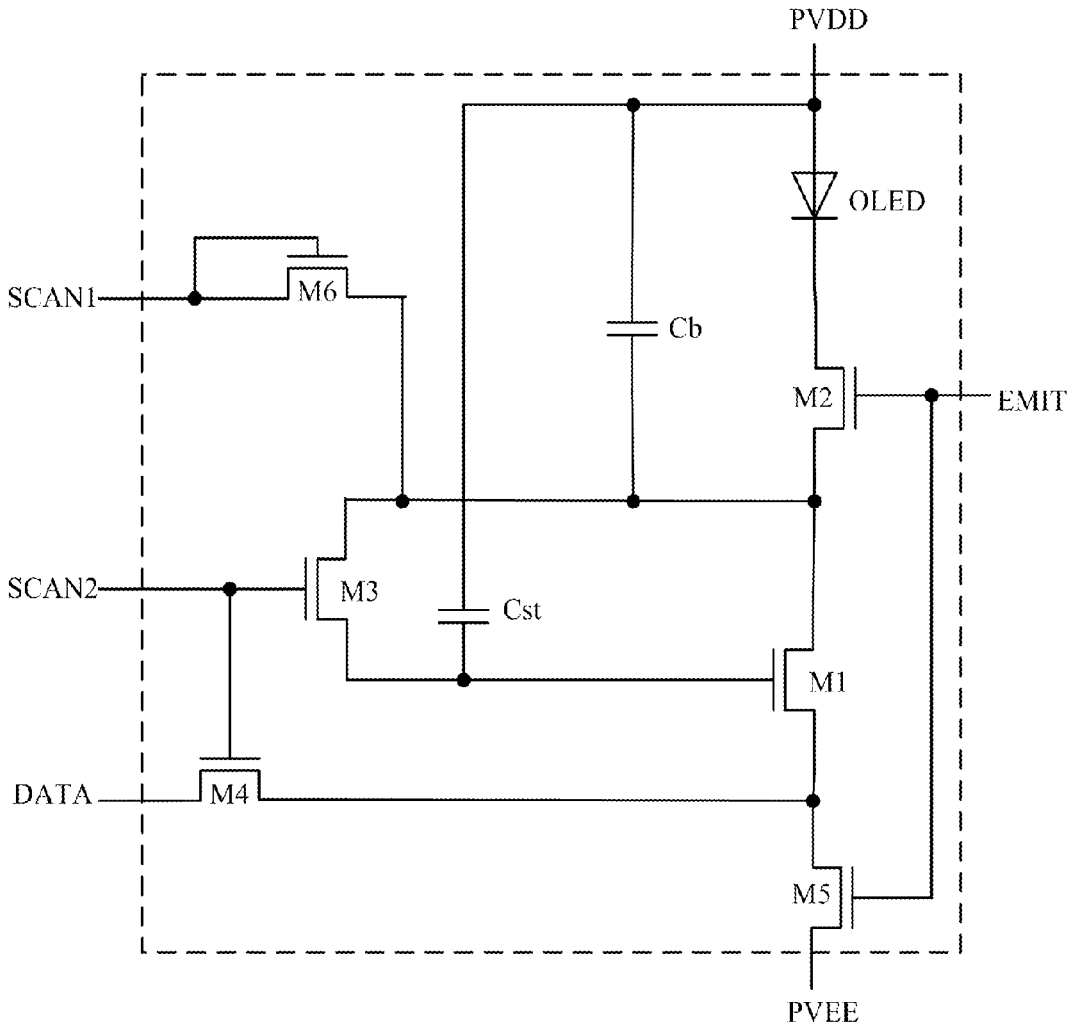
FIG. 6 illustrates a circuit diagram of an all-NMOS pixel circuit of an organic light-emitting display according to an embodiment of the invention.

Preferably the pixel circuit as illustrated in FIG. 2 further includes a second capacitor Cb, a first scan line SCAN1, and a sixth thin film transistor M6. As illustrated in FIG. 6, the second capacitor Cb is connected between the anode of the Organic Light-Emitting Diode (OLED) and the second electrode of the first thin film transistor M1, and both a gate and a second electrode of the sixth thin film transistor M6 are connected with the first scan SCAN1, and a first electrode of the sixth thin film transistor M6 is connected with the second electrode of the first thin film transistor M1. With the pixel circuit, the gate voltage and the source voltage of the first thin film transistor can be coupled and maintained in the data write phase, and also in the threshold voltage drift of the first thin film transistor can be compensated.

With the extension above, in addition to the process of driving the pixel circuit as illustrated in FIG. 2, the method of driving the pixel circuit as illustrated in FIG. 4 further includes: in the data write phase T1, the first thin film transistor M1 is turned on to charge the second capacitor Cb, and discharge the second capacitor Cb after the second capacitor Cb has been charged (at the end of being charged), and during the second capacitor Cb is being discharged, the first capacitor Cst starts to store charge, and the first capacitor Cst stores charge until the gate voltage of the first thin film transistor M1 drops to the second voltage ($V_{DATA}$+$V_{TH}$) and the first thin film transistor M1 is turned off at this time, and after the first thin film transistor M1 is turned off, the gate voltage of the first thin film transistor M1 is maintained at ($V_{DATA}$−$N_{TH}$). The second capacitor can be charged and discharged so that the gate voltage of the first thin film transistor is coupled, and the threshold voltage drift of the first thin film transistor is compensated for, such that the coupled gate voltage of the first thin film transistor is the sum of the first voltage and the threshold voltage, thus light emission by the OLED in the light emission phase T2 is independent of the threshold voltage of the drive transistor.

Figure 7:
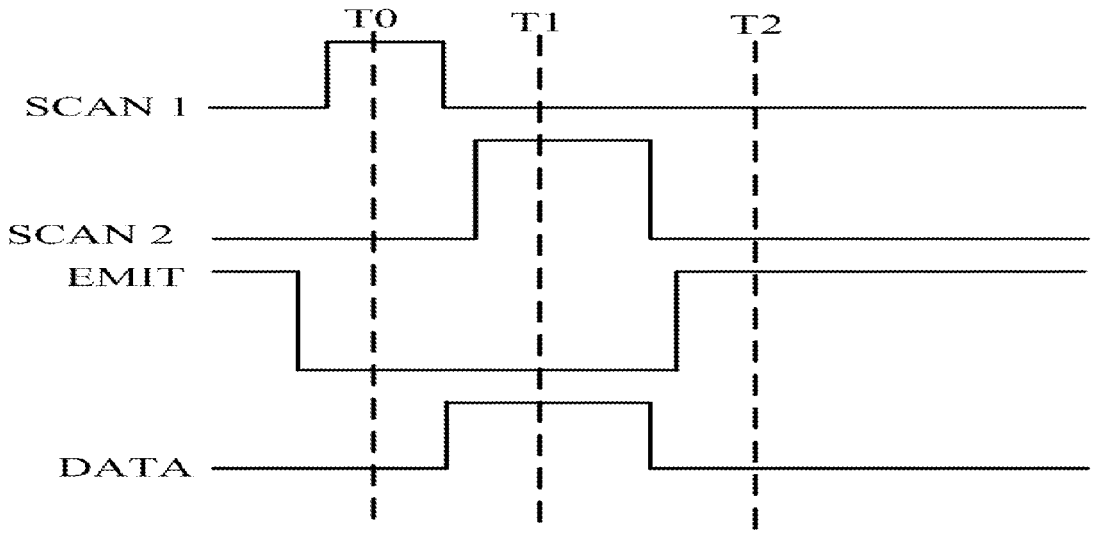
FIG. 7 illustrates a timing diagram of a signal input of the pixel circuit as illustrated in FIG. 5 and FIG. 6 according to an embodiment of the invention.

With the extension above, the timing diagram of the pixel circuit as illustrated in FIG. 5 further includes an initialization phase T0, as illustrated in FIG. 7, in the initialization phase T0, the first scan line SCAN1 is at a high level, the second scan line SCAN2 is at a low level, and the light emission control signal line EMIT is at a low level. In the initialization phase T0, a high level is applied to the first scan line SCAN1 so that the sixth thin film transistor M6 is turned on as a diode, and the voltage of the second electrode of the first thin film transistor M1 is set at a third voltage, the value of which is the amplitude of the high level applied to SCAN1. In the present embodiment, the voltage of the second electrode of the first thin film transistor can be reset, before the data is written, to thereby prevent the OLED from emitting light abnormally due to the threshold voltage drift arising from the drain voltage of the drive transistor M1 being at a high potential for a long period of time.

With the extension above, a method of driving the pixel circuit as illustrated in FIG. 6 is particularly as follows in connection with the timing diagram as illustrated in FIG. 7:

In the initialization phase T0, a high level is applied to the first scan line SCAN1 so that the sixth thin film transistor M6 is turned on as a diode, and the voltage of the second electrode of the first thin film transistor M1 is set at the third voltage, the value of which is the amplitude of the high level applied to SCAN1;

In the data write phase T1, a high level is applied to the second scan line SCAN2 so that the third thin film transistor M3, the fourth thin film transistor M4, and the first thin film transistor M1 are turned on, where the first thin film transistor M1 is turned on because in the initialization phase T0, the voltage of the second electrode (the drain) of the first thin film transistor M1 is set at the high-level third voltage, and the charging capacitor Cb maintains the drain of the first thin film transistor at the high-level third voltage, and after a high level is applied to the second scan line SCAN2 so that the third thin film transistor M3 is turned on, both the gate and the drain of the first thin film transistor are at a high level so that the first thin film transistor M1 is turned on; the low level is applied to the light emission control signal line EMIT so that the second thin film transistor M2 and the fifth thin film transistor M5 are tuned off; a high level is applied to the data line DATA so that the voltage of the first electrode of the first thin film transistor M1 is first voltage $V_{DATA}$; and due to the first thin film transistor M1 being turned on, the second capacitor Cb starts to be charged, and the second capacitor Cb is discharged at the end of being charged, and during the second capacitor Cb is being discharged, the first capacitor Cst starts to store charges until the gate voltage of the first thin film transistor M1 drops to second voltage ($V_{DATA}+V_{TH}$) and the first thin film transistor M1 is turned off at this time, and after the first thin film transistor M1 is turned off, the gate voltage of the first thin film transistor M1 is maintained at the second voltage ($V_{DATA}+V_{TH}$), $V_{DATA}$ represents high-level voltage applied to the data line DATA, and $V_{TH}$ represents threshold voltage of the first thin film transistor M1.

In the light emission phase T2, a low level is applied to the second scan line SCAN2 so that the third thin film transistor M3 and the fourth thin film transistor M4 are turned off; a high level is applied to the light emission control signal line EMIT so that the second thin film transistor M2 and the fifth thin film transistor M5 are turned on, and due to the fifth thin film transistor M5 being turned on, the voltage of the first electrode of the first thin film transistor M1 is the voltage of the second power supply PVEE, and the gate voltage of the first thin film transistor M1 is the second voltage ($V_{DATA}+V_{TH}$), and the gate-source voltage of the first thin film transistor ($V_{DATA}+V_{TH}-$PVEE) turns on the first thin film transistor M1, and drive current generated by the first thin film transistor M1 being turned on drives the organic light-emitting diode to emit light.

With the embodiment above, a threshold voltage drift of the first thin film transistor can be compensated for so that the second voltage is the sum of the first voltage and the threshold voltage of the thin film transistor, and the difference between the gate-source voltage and the threshold voltage of the first thin film transistor in the light emission phase T2 is the difference between the first voltage and the voltage of the second power supply, thus light emission by the OLED is independent of the threshold voltage of the drive transistor.

Figure 8:
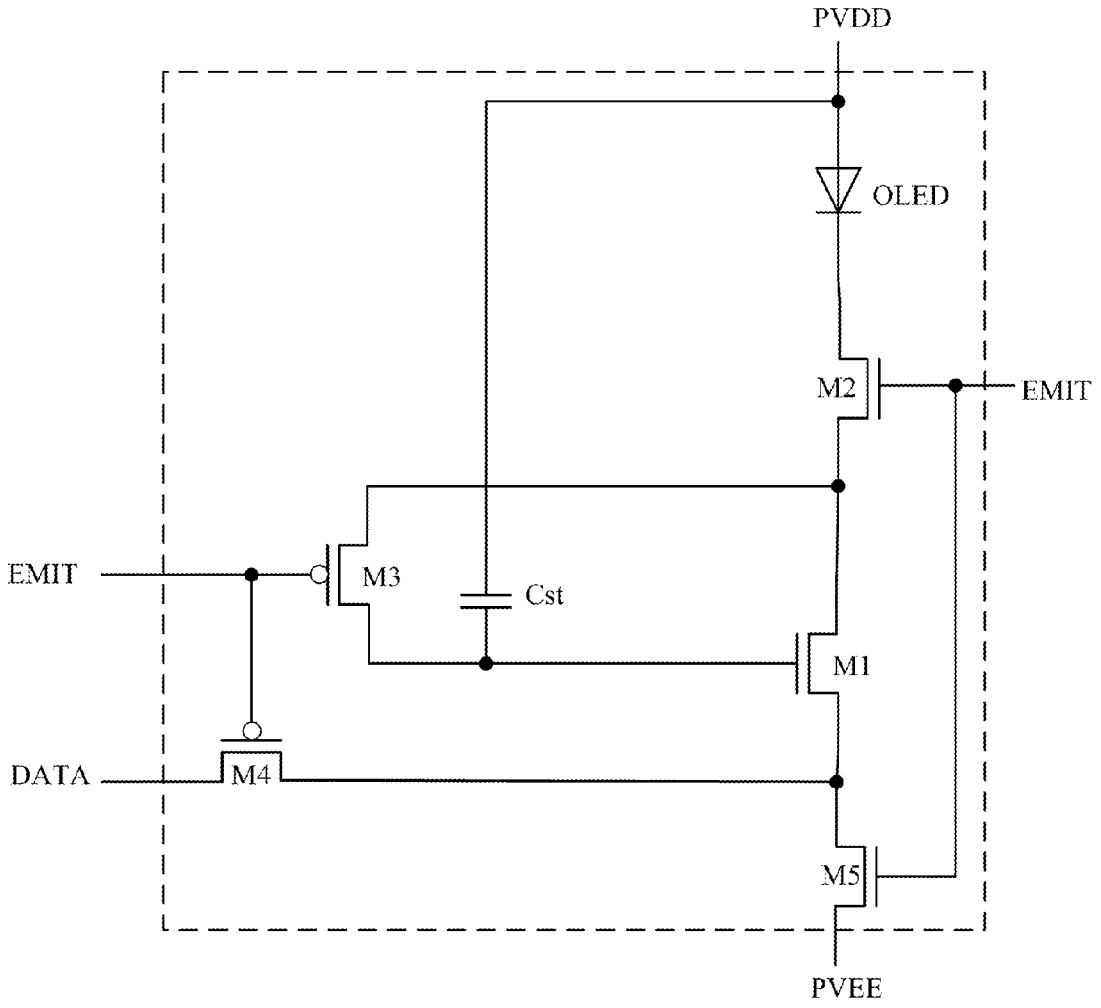
FIG. 8 illustrates a circuit diagram of a CMOS pixel circuit of an organic light-emitting display according to an embodiment of the invention.

FIG. 8 illustrates a circuit diagram of a pixel circuit of an organic light-emitting display according to an embodiment of the invention. The pixel circuit is a CMOS pixel circuit including a first thin film transistor M1, a second thin film transistor M2, a third thin film transistor M3, a fourth thin film transistor M4, a fifth thin film transistor M5, a first capacitor Cst which is a storage capacitor, and an Organic Light-Emitting Diode (OLED).

A gate of the first thin film transistor M1 is connected with a first electrode of the third thin film transistor M3, a first electrode of the first thin film transistor M1 is connected with a second electrode of the fifth thin film transistor M5, and a second electrode of the first thin film transistor M1 is connected with a first electrode of the second thin film transistor M2;

A gate of the second thin film transistor M2 is connected with a light emission control signal line EMIT, a second electrode of the second thin film transistor M2 is connected with a cathode of the Organic Light-Emitting Diode (OLED), and an anode of the Organic Light-Emitting Diode (OLED) is connected with a first power supply PVDD;

A gate of the third thin film transistor M3 is connected with a first signal line, and a second electrode of the third thin film transistor M3 is connected with the first electrode of the second thin film transistor M2;

A gate of the fourth thin film transistor M4 is connected with the first signal line, a first electrode of the fourth thin film transistor M4 is connected with the first electrode of the first thin film transistor M1 and the second electrode of the fifth thin film transistor M5, and a second electrode of the fourth thin film transistor M4 is connected with a data line DATA;

A gate of the fifth thin film transistor M5 is connected with the light emission control signal line EMIT, and a first electrode of the fifth thin film transistor M5 is connected with a second power supply; and The first capacitor Cst is connected between the anode of the Organic Light-Emitting Diode (OLED) and the gate of the first thin film transistor M1.

In the pixel circuit as illustrated FIG. 8, the first power supply PVDD provides a voltage which is higher than the voltage provided by the second power supply PVEE. The third thin film transistor M3 and the fourth thin film transistor M4 are P-type thin film transistors, and the other thin film transistors are N-type thin film transistors, the first signal line is the light emission control signal line EMIT, the first electrodes of the P-type thin film transistors are drains and the second electrodes thereof are sources, and the first electrodes of the N-type thin film transistors are sources and the second electrodes are drains. In addition to stabilize the gate voltage and the source voltage of the first thin film transistor and compensate threshold voltage of the first thin film transistor, the CMOS pixel circuit according to the embodiment of the invention can be fabricated with a smaller number of scan lines and an improvement in utilization ratio of the light emission control signal line.

As compared with FIG. 1, in the pixel circuit as illustrated in FIG. 8 according to the embodiment of the invention, the Organic Light-Emitting Diode (OLED) is not disposed at the second power supply PVEE through the fifth thin film transistor, but instead the anode of the Organic Light-Emitting Diode (OLED) is connected with the first power supply PVDD so that the source of the first thin film transistor is connected with the second power supply PVEE, thus defining the source voltage of the drive transistor M1 and avoiding the gate-source voltage of the drive transistor M1 from being undefined.

Figure 9:
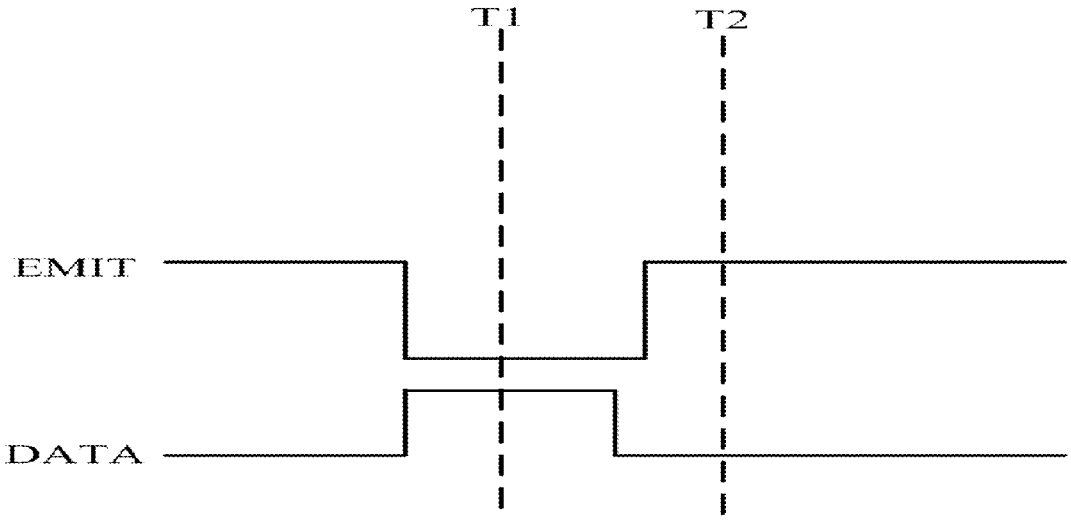
FIG. 9 illustrates a timing diagram of a signal input of the pixel circuit as illustrated in FIG. 8 according to an embodiment of the invention.

FIG. 9 illustrates a timing diagram of the pixel circuit as illustrated in FIG. 8, in which in a data write phase T1, the data line DATA is at a high level, and the light emission control signal line EMIT is at a low level; and in a light emission phase T2, the light emission control signal line EMIT is at a high level.

With the timing diagram illustrated in FIG. 9, a method of driving the pixel circuit as illustrated in FIG. 8 is as follows:

In the data write phase T1, a low level is applied to the light emission control signal line EMIT so that the third thin film transistor M3, the fourth thin film transistor M4, and the first thin film transistor M1 are turned on, and the second thin film transistor M2 and the fifth thin film transistor M5 are turned off; the first thin film transistor M1 is turned on because: before the data write phase T1, a temporary high-level signal of the light emission control signal line EMIT (as illustrated in FIG. 9) turns on the second thin film transistor M2, and the storage capacitor Cst maintains the drain of the first thin film transistor M1 at a high level, and in the data write phase T1, after a low level is applied to the light emission control signal line EMIT so that the third thin film transistor M3 is turned on, both the gate and the drain of the first thin film transistor M1 are at a high level so that the first thin film transistor M1 is turned on; a high level is applied to the data line DATA so that the voltage of the first electrode of the first thin film transistor M1 is the first voltage $V_{DATA}$; and due to the first thin film transistor M1 being turned on, the first capacitor Cst starts to store charges until the gate voltage of the first thin film transistor M1 drops to second voltage ($V_{DATA}-N_{TH}$) and the first thin film transistor M1 is turned off at this time, and after the first thin film transistor M1 is turned off, the gate voltage of the first thin film transistor M1 is maintained at the second voltage ($V_{DATA}+V_{TH}$), $V_{DATA}$ represents high-level voltage applied to the data line DATA, and $V_{TH}$ represents threshold voltage of the first thin film transistor M1; and In the light emission phase T2, a high level is applied to the light emission control signal line EMIT so that the third thin film transistor M3 and the fourth thin film transistor M4 are turned off, and the second thin film transistor M2 and the fifth thin film transistor M5 are turned on, and the fifth thin film transistor M5 is turned on so that the voltage of the first electrode of the first thin film transistor M1 is the voltage of the second power supply PVEE, and the gate voltage of the first thin film transistor M1 is the second voltage ($V_{DATA}+V_{TH}$), and the gate-source voltage of the first thin film transistor ($V_{DATA}+V_{TH}-PVEE$) turns on the first thin film transistor M1, and drive current $$I_{OLED} = \frac{1}{2}\mu C_{OX}\frac{W}{L}(V_{DATA} - V_{PVEE})^2$$

generated by the first thin film transistor M1 being turned on drives the organic light-emitting diode to emit light.

In the embodiment above, the light emission control signal in the data write phase T1 turns off the second thin film transistor and the fifth thin film transistor, thus ensuring the OLED not to emit light temporarily before and after the threshold voltage of the first thin film transistor is compensated for so as to prevent insufficient darkness of the OLED being dimmed. In the embodiment above, in the data write phase T1, the light emission control signal turns on the P-type third thin transistor and the P-type fourth transistor so that during the first thin film transistor from being turned on to being turned off, the gate voltage of the first thin film transistor is coupled and the threshold voltage thereof is captured and stored in the gate voltage, and the coupled gate voltage of the first thin film transistor (the sum of the first voltage and the threshold voltage of the first thin film transistor) is maintained due to the first capacitor. In the embodiment above, in the light emission phase T2, the second and fifth thin film transistors are turned on so that the threshold voltage of the first thin film transistor is captured in the gate-source voltage of the first thin film transistor (the first voltage+the threshold voltage of the first thin film transistor−the voltage of the second power supply), thus ensuring light emission by the OLED to be independent of the threshold voltage of the drive transistor.

Figure 10:
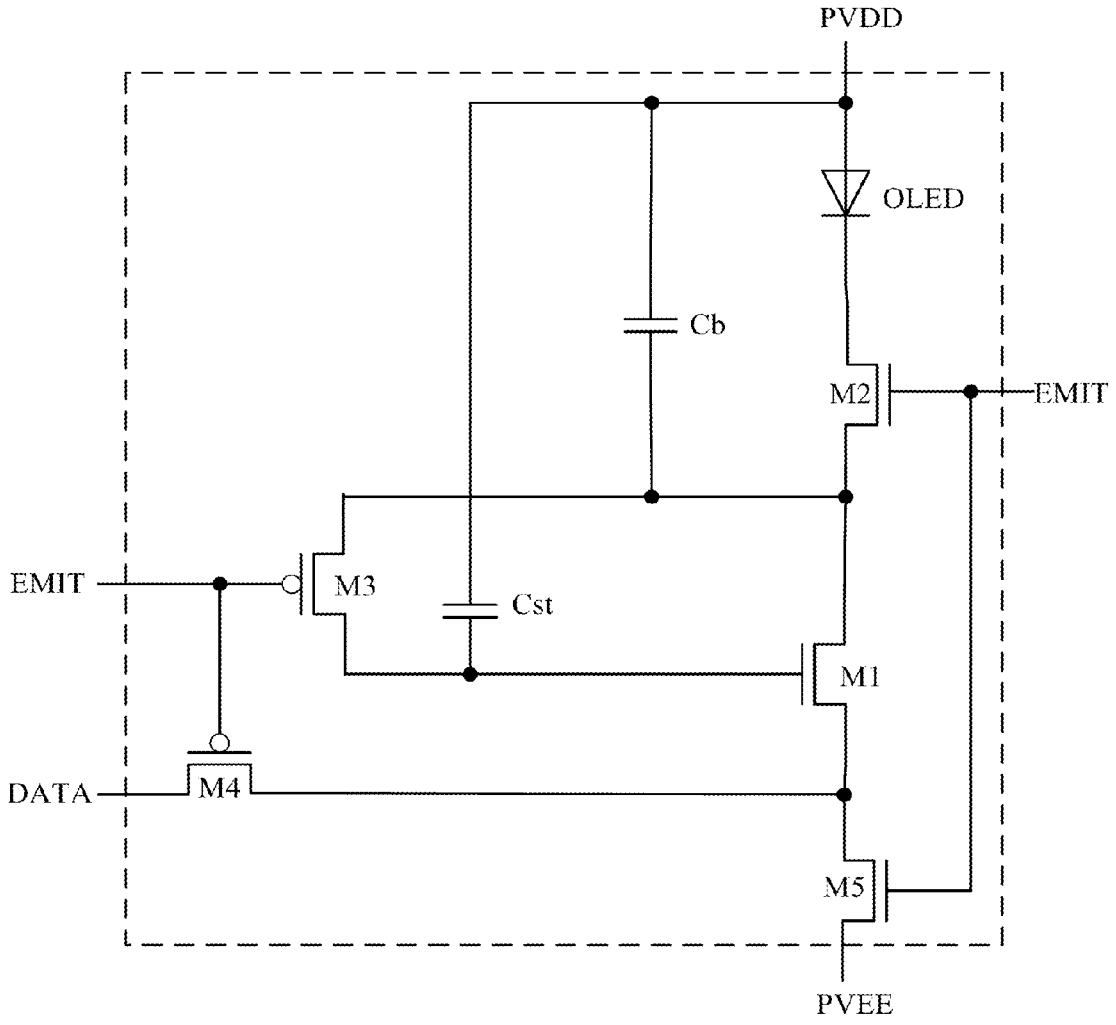
FIG. 10 illustrates a circuit diagram of a CMOS pixel circuit of an organic light-emitting display according to an embodiment of the invention.

In the present embodiment, the pixel circuit as illustrated in FIG. 8 can be further extended particularly as follows:

Preferably, the pixel circuit as illustrated in FIG. 8 further includes a second capacitor Cb, as illustrated in FIG. 10, the second capacitor Cb is connected between the anode of the Organic Light-Emitting Diode (OLED) and the second electrode of the first thin film transistor M1, the second capacitor Cb is a charging capacitor; and the second capacitor can be added so that the threshold voltage of the drive transistor is captured in the data write phase T1, and the coupled gate voltage is maintained before the light emission phase T2.

Figure 11:
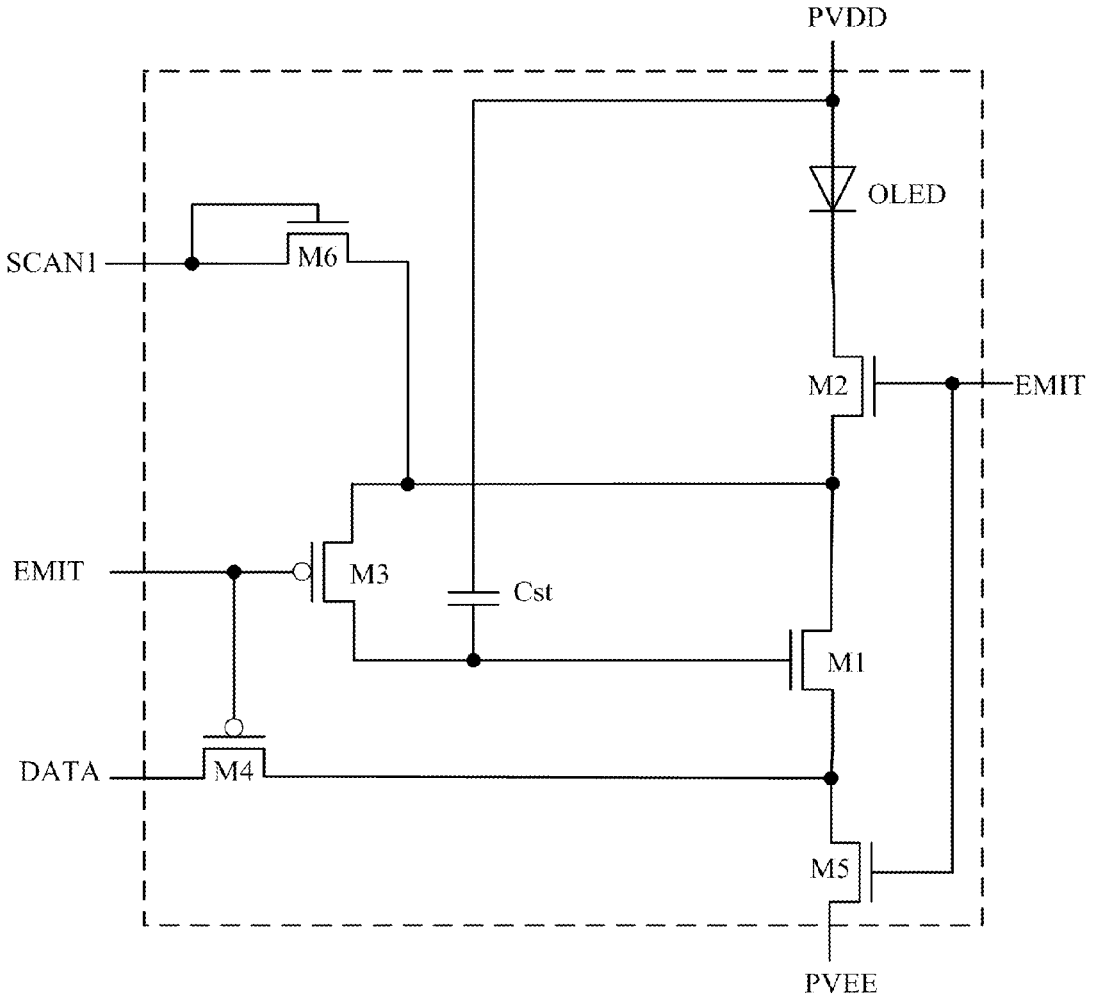
FIG. 11 illustrates a circuit diagram of a CMOS pixel circuit of an organic light-emitting display according to an embodiment of the invention.

Preferably, the pixel circuit as illustrated in FIG. 8 further includes a first scan line SCAN1 and a sixth thin film transistor M6, and as illustrated in FIG. 11, both a gate and a second electrode of the sixth thin film transistor M6 are connected with the first scan line SCAN1, and a first electrode of the sixth thin film transistor M6 is connected with the second electrode of the first thin film transistor M1; and the first scan line and the sixth thin film transistor can be added so that the drain voltage of the drive transistor M1 can be reset before the signal is written, to thereby prevent the OLED from emitting light abnormally due to a threshold voltage drift arising from the drain voltage of the drive transistor M1 being at a high potential for a long period of time.

Figure 12:
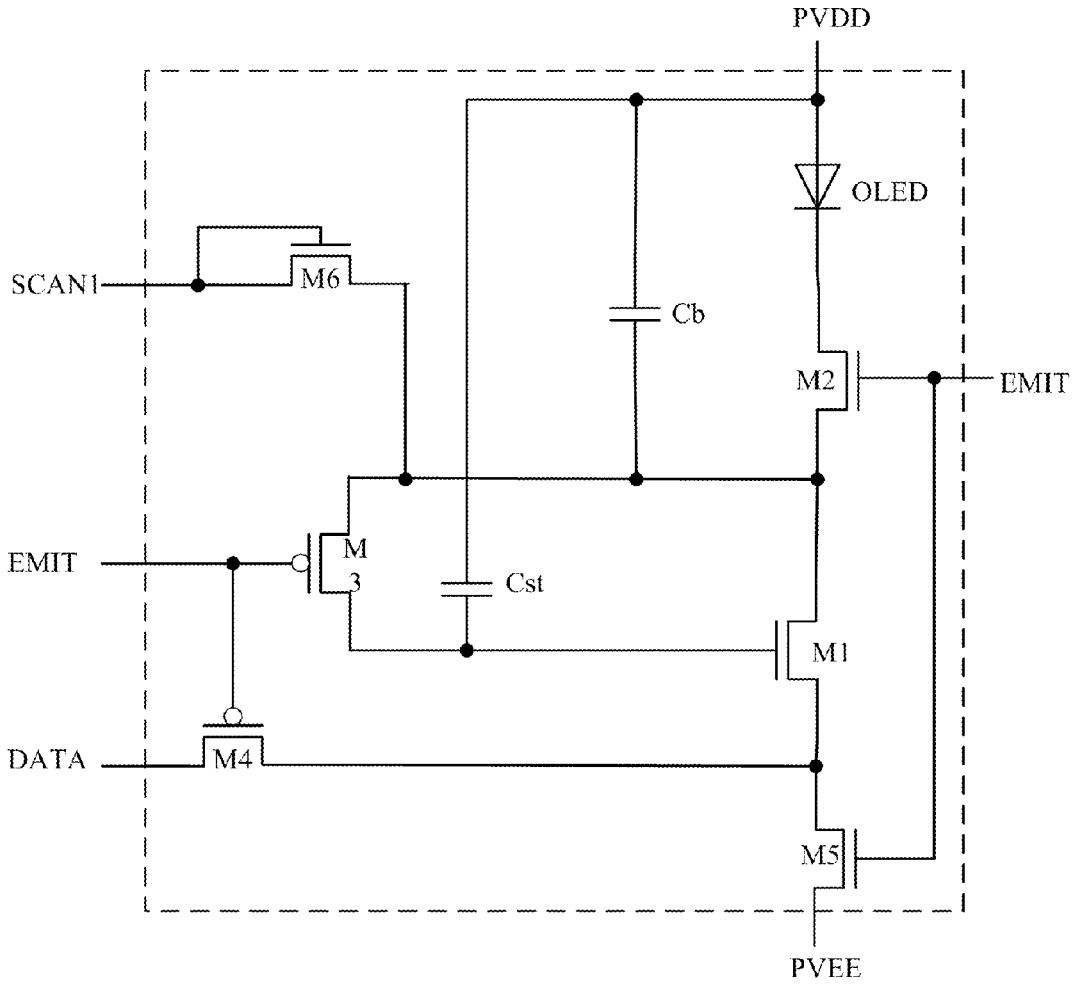
FIG. 12 illustrates a circuit diagram of a CMOS pixel circuit of an organic light-emitting display according to an embodiment of the invention.

Preferably the pixel circuit as illustrated in FIG. 8 further includes a second capacitor Cb, a first scan line SCAN1, and a sixth thin film transistor M6, and as illustrated in FIG. 12, the second capacitor Cb is connected between the anode of the Organic Light-Emitting Diode (OLED) and the second electrode of the first thin film transistor M1, and both a gate and a second electrode of the sixth thin film transistor M6 are connected with the first scan SCAN1, and a first electrode of the sixth thin film transistor M6 is connected with the second electrode of the first thin film transistor M1.

With the extension above, in addition to the process of driving the pixel circuit in FIG. 8, the method of driving the pixel circuit as illustrated in FIG. 10 further includes: in the data write phase T1, the first thin film transistor M1 is turned on so that the second capacitor Cb starts to be charged, and the second capacitor Cb is discharged at the end of being charged, and during the second capacitor Cb is being discharged, the first capacitor Cst starts to store charges, and the first capacitor Cst stores charges until the gate voltage of the first thin film transistor M1 drops to the second voltage ($V_{DATA}+V_{TH}$) and the first thin film transistor M1 is turned off at this time, and after the first thin film transistor M1 is turned off, the gate voltage of the first thin film transistor M1 is maintained at ($V_{DATA}+V_{TH}$). The second capacitor can be charged and discharged so that the gate voltage of the first thin film transistor is coupled, and the threshold voltage drift of the first thin film transistor is compensated for, such that the coupled gate voltage of the first thin film transistor is the sum of the first voltage and the threshold voltage, thus the light emission by the OLED in the light emission phase T2 is independent of the threshold voltage of the drive transistor.

Figure 13:
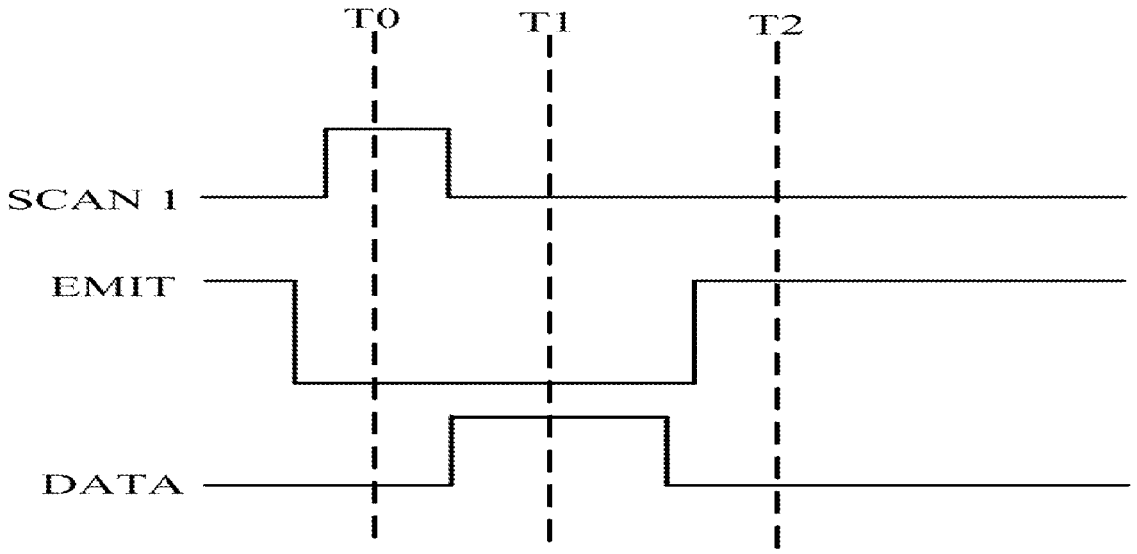
FIG. 13 illustrates a timing diagram of a signal input of the pixel circuit as illustrated in FIG. 11 and FIG. 12 according to an embodiment of the invention.

With the extension above, the timing diagram of the pixel circuit as illustrated in FIG. 11 further includes an initialization phase T0, as illustrated in FIG. 13, in the initialization phase T0, the first scan line SCAN1 is at a high level. In the initialization phase T0, a high level is applied to the first scan line SCAN1 so that the sixth thin film transistor M6 is turned on as a diode, and the voltage of the second electrode of the first thin film transistor M1 is set at third voltage, the value of the third voltage is the amplitude of the high level applied to SCAN1. In the present embodiment, the voltage of the second electrode of the first thin film transistor can be reset, before the data is written, to thereby prevent the OLED from emitting light abnormally due to the threshold voltage drift arising from the drain voltage of the drive transistor M1 being at a high potential for a long period of time.

With the extension above, a method of driving the pixel circuit as illustrated in FIG. 12 is particularly as follows in connection with the timing diagram as illustrated in FIG. 13:

In the initialization phase T0, a high level is applied to the first scan line SCAN1 so that the sixth thin film transistor M6 is turned on as a diode, and the voltage of the second electrode of the first thin film transistor M1 is set at third voltage, the value of the third voltage is the amplitude of the high level applied to SCAN1;

In the data write phase T1, a low level is applied to the light emission control signal line EMIT so that the third thin film transistor M3, the fourth thin film transistor M4, and the first thin film transistor M1 are turned on, and the second thin film transistor M2 and the fifth thin film transistor M5 are turned off, and the first thin film transistor M1 is turned on because in the initialization phase T0, the voltage of the second electrode (the drain) of the first thin film transistor M1 is set at the high-level third voltage, and the charging capacitor Cb maintains the drain of the first thin film transistor at the high-level third voltage, and in the data write phase, after a low level is applied to the light emission control signal line EMIT so that the third thin film transistor M3 is turned on, both the gate and the drain of the first thin film transistor are at a high level so that the first thin film transistor M1 is turned on; a high level is applied to the data line DATA so that the voltage of the first electrode of the first thin film transistor M1 is first voltage $V_{DATA}$; and due to the first thin film transistor M1 being turned on, the second capacitor Cb starts to be charged, and the second capacitor Cb is discharged at the end of being charged, and during the second capacitor Cb is being discharged, the first capacitor Cst starts to store charges until the gate voltage of the first thin film transistor M1 drops to second voltage ($V_{DATA}$+$V_{TH}$) and the first thin film transistor M1 is turned off at this time, and after the first thin film transistor M1 is turned off, the gate voltage of the first thin film transistor M1 is maintained at the second voltage ($V_{DATA}$+$V_{TH}$), $V_{DATA}$ represents high-level voltage applied to the data line DATA, and $V_{TH}$ represents threshold voltage of the first thin film transistor M1; and In the light emission phase T2, a high level is applied to the light emission control signal line EMIT so that third thin film transistor M3 and the fourth thin film transistor M4 are turned off, and the second thin film transistor M2 and the fifth thin film transistor M5 are turned on, and the fifth thin film transistor M5 is turned on so that the voltage of the first electrode of the first thin film transistor M1 is the voltage of the second power supply PVEE, and the gate voltage of the first thin film transistor M1 is the second voltage ($V_{DATA}$+$V_{TH}$), and the gate-source voltage of the first thin film transistor ($V_{DATA}$+$V_{TH}$−PVEE) turns on the first thin film transistor M1, and drive current generated by the first thin film transistor M1 being turned on drives the organic light-emitting diode to emit light.

With the embodiment above, the threshold voltage drift of the first thin film transistor can be compensated for so that the second voltage is the sum of the first voltage and the threshold voltage of the thin film transistor, and the difference between the gate-source voltage and the threshold voltage of the first thin film transistor in the light emission phase T2 is the difference between the first voltage and the voltage of the second power supply, thus light emission by the OLED is independent of the threshold voltage of the drive transistor.

Based upon the same technical idea, an embodiment of the invention further provides an organic light-emitting display, and reference can be made to the method embodiments above for details of the organic light-emitting display, so a repeated description thereof will be omitted here.

Figure 14:
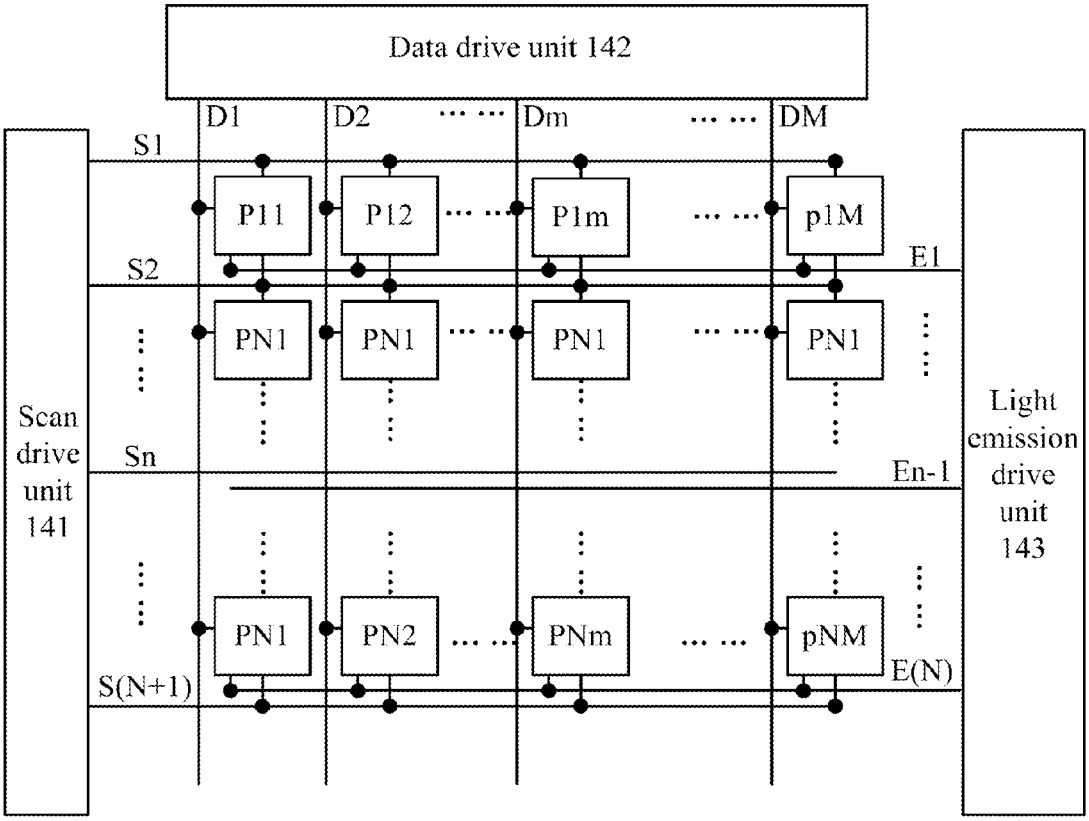
FIG. 14 illustrates a circuit diagram of an organic light-emitting display based upon an all-NMOS pixel circuit according to an embodiment of the invention.

Based upon the all-NMOS pixel circuit above, FIG. 14 illustrates an organic light-emitting display according to an embodiment of the invention. The organic light-emitting display includes:

A scan drive unit 141, a data drive unit 142, a light emission drive unit 143, N+1 scan lines SCAN, M data lines DATA, and N light emission control signal lines EMIT; and an array of pixel circuits including the pixel circuits in N rows by M columns, in which:

In the array of pixel circuits, the gates of the third thin film transistors and the fourth thin film transistors of the n-th row of pixel circuits are connected with the (n+1)-th scan line, the second electrodes of the fourth thin film transistors of the m-th column of pixel circuits are connected with the m-th data line, and the gates of the second thin film transistors and the fifth thin film transistors of the n-th row of pixel circuits are connected with the n-th light emission control signal line, $1 \le n \le N$, and $1 \le m \le M$;

The scan drive unit 141 is configured to provide the respective scan lines with a scan signal;

The data drive unit 142 is configured to provide the respective data lines with a data signal; and The light emission drive unit 143 is configured to provide the respective light emission control signal lines with a light emission control signal.

Preferably, the scan drive unit 141 is further configured to apply a high level to the (n+1)-th scan line in the data write phase; and to apply a low level on the (n+1)-th scan line in the light emission phase;

The data drive unit 142 is further configured to apply a high level on the m-th data line in the data write phase; and The light emission drive unit 143 is further configured to apply a low level on the n-th light emission control signal line in the data write phase; and to apply a high level on the n-th light emission control signal line in the light emission phase.

Preferably, the scan drive unit 141 is further configured to apply a high level to the n-th scan line and a low level on the (n+1)-th scan line in the initialization phase; and to apply a low level to the n-th scan line in the data write phase and the light emission phase; and The light emission drive unit 143 is further configured to apply a low level on the n-th light emission control signal line in the initialization phase.

In the embodiment above, the organic light-emitting display is characterized above to thereby ensure the all-NMOS pixel circuits to be driven normally so as to compensate for the threshold voltage drift of the first thin film transistors and to stabilize the gate voltage and the source voltage of the first thin film transistors being compensated.

Figure 15:
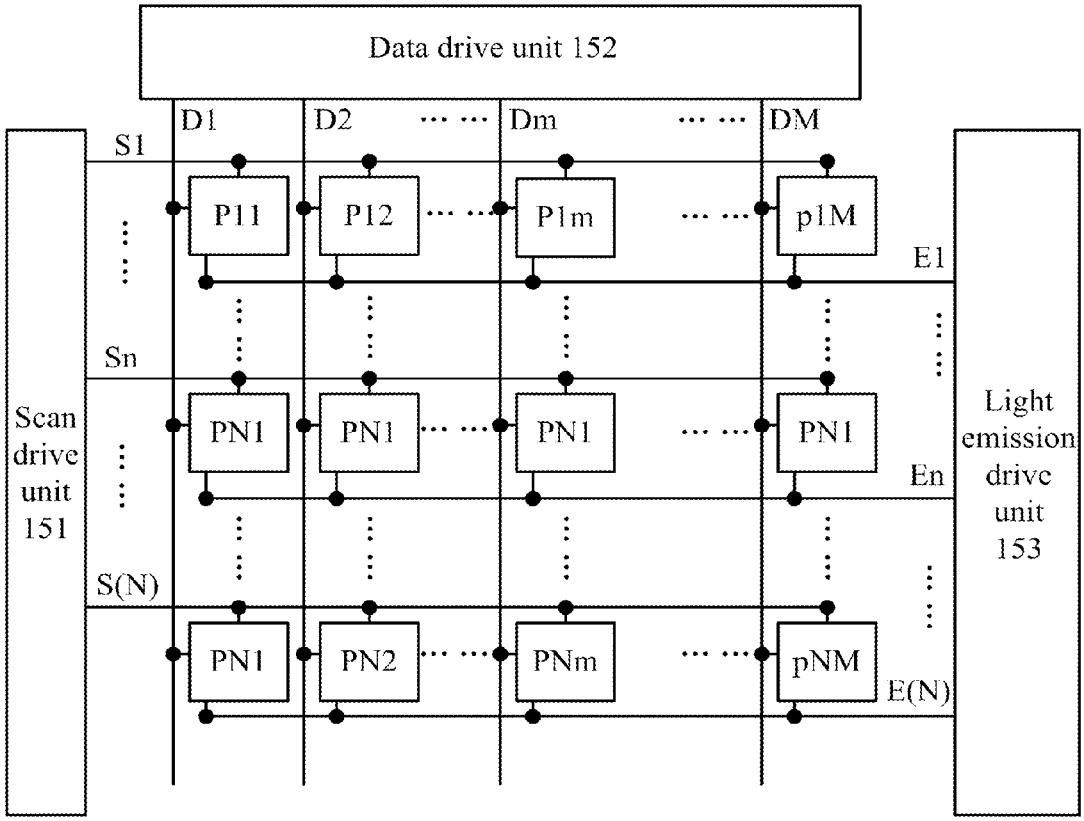
FIG. 15 illustrates a circuit diagram of an organic light-emitting display based upon a CMOS pixel circuit according to an embodiment of the invention.

Based upon the CMOS pixel circuit above, FIG. 15 illustrates an organic light-emitting display according to an embodiment of the invention, the organic light-emitting display including:

A scan drive unit 151, a data drive unit 152, a light emission drive unit 153, N scan lines SCAN, M data lines DATA, and N light emission control signal lines EMIT; and an array of pixel circuits including the pixel circuits in N rows by M columns, in which:

In the array of pixel circuits, the gates of the third thin film transistors and the sixth thin film transistors of the n-th row of pixel circuits are connected with the n-th light emission control signal line, the first electrodes of the sixth thin film transistors of the m-th column of pixel circuits are connected with the m-th data line, and the gates of the second thin film transistors and the fifth thin film transistors of the n-th row of pixel circuits are connected with the n-th light emission control signal line, $1 \leq n \leq N$, and $1 \leq m \leq M$;

The scan drive unit 151 is configured to provide the respective scan lines with a scan signal;

The data drive unit 152 is configured to provide the respective data lines with a data signal; and The light emission drive unit 153 is configured to provide the respective light emission control signal lines with a light emission control signal.

Preferably,

The data drive unit 152 is further configured to apply a high level on the m-th data line in the data write phase; and The light emission drive unit 153 is further configured to apply a low level on the n-th light emission control signal line in the data write phase; and to apply a high level on the n-th light emission control signal line in the light emission phase.

Preferably, the scan drive unit 151 is further configured to apply a high level on the n-th scan line in the initialization phase; and to apply a low level on the n-th scan line in the data write phase and the light emission phase.

In the embodiment above, the organic light-emitting display is characterized above to thereby ensure the CMOS pixel circuits to be driven normally so as to compensate for the threshold voltage drift of the first thin film transistors and to stabilize the gate voltage and the source voltage of the first thin film transistors being compensated.

Although the preferred embodiments of the invention have been described, those skilled in the art benefiting from the underlying inventive concept can make additional modifications and variations to these embodiments. Therefore the appended claims are intended to be construed as encompassing the preferred embodiments and all the modifications and variations coming into the scope of the invention.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

What is claimed is:

1. A pixel circuit of an organic light-emitting display, comprising:

a first thin film transistor, a second thin film transistor, a third thin film transistor, a fourth thin film transistor, a fifth thin film transistor, a first capacitor, and a light-emitting diode;

a gate of the first thin film transistor is connected with a first electrode of the third thin film transistor, a first electrode of the first thin film transistor is connected with a second electrode of the fifth thin film transistor, and a second electrode of the first thin film transistor is connected with a first electrode of the second thin film transistor;

a gate of the second thin film transistor is connected with a light emission control signal line, a second electrode of the second thin film transistor is connected with a cathode of the light-emitting diode, and an anode of the light-emitting diode is connected with a first power supply;

a gate of the third thin film transistor is connected with a first signal line, and a second electrode of the third thin film transistor is connected with the first electrode of the second thin film transistor;

a gate of the fourth thin film transistor is connected with the first signal line, a first electrode of the fourth thin film transistor is connected with the first electrode of the first thin film transistor and the second electrode of the fifth thin film transistor, and a second electrode of the fourth thin film transistor is connected with a data line;

a gate of the fifth thin film transistor is connected with the light emission control signal line, and a first electrode of the fifth thin film transistor is connected with a second power supply; and the first capacitor is connected between the anode of the light-emitting diode and the gate of the first thin film transistor.

2. The pixel circuit according to claim 1, further comprising a second capacitor connected between the anode of the light-emitting diode and the second electrode of the first thin film transistor.

3. The pixel circuit according to claim 1, wherein the first power supply provides a voltage which is higher than a voltage provided by the second power supply.

4. A pixel circuit of an organic light-emitting display, comprising:

a first thin film transistor, a second thin film transistor, a third thin film transistor, a fourth thin film transistor, a fifth thin film transistor, a first capacitor, and a light-emitting diode, wherein a gate of the first thin film transistor is connected with a first electrode of the third thin film transistor, a first electrode of the first thin film transistor is connected with a second electrode of the fifth thin film transistor, and a second electrode of the first thin film transistor is connected with a first electrode of the second thin film transistor;

a gate of the second thin film transistor is connected with a light emission control signal line, a second electrode of the second thin film transistor is connected with a cathode of the light-emitting diode, and an anode of the light-emitting diode is connected with a first power supply;

a gate of the third thin film transistor is connected with a first signal line, and a second electrode of the third thin film transistor is connected with the first electrode of the second thin film transistor;

a gate of the fourth thin film transistor is connected with the first signal line, a first electrode of the fourth thin film transistor is connected with the first electrode of the first thin film transistor and the second electrode of the fifth thin film transistor, and a second electrode of the fourth thin film transistor is connected with a data line;

a gate of the fifth thin film transistor is connected with the light emission control signal line, and a first electrode of the fifth thin film transistor is connected with a second power supply; and the first capacitor is connected between the anode of the light-emitting diode and the gate of the first thin film transistor, and the pixel circuit further includes:

a second capacitor connected between the anode of the light-emitting diode and the second electrode of the first thin film transistor; and a first scan line and a sixth thin film transistor, wherein a gate and a second electrode of the sixth thin film transistor are connected with the first scan line, and a first electrode of the sixth thin film transistor is connected with the second electrode of the first thin film transistor.

5. The pixel circuit according to claim 4, wherein the first thin film transistor, the second thin film transistor, the third thin film transistor, the fourth thin film transistor, the fifth thin film transistor, and the sixth thin film transistor are N-type thin film transistors, the first signal line is a second scan line, the first electrodes are sources, and the second electrodes are drains.

6. A method of driving the pixel circuit according to claim 5, comprising:

in a data write phase, applying a high level to the second scan line to turn on the third thin film transistor, the fourth thin film transistor, and the first thin film transistor; applying a low level to the light emission control signal line to turn off the second thin film transistor and the fifth thin film transistor; applying a high level to the data line so that a voltage of the first electrode of the first thin film transistor is a first voltage; and when the first thin film transistor is turned on, the first capacitor starts to store charge until a gate voltage of the first thin film transistor drops to a second voltage and the first thin film transistor is turned off at this time, and after the first thin film transistor is turned off, the gate voltage of the first thin film transistor is maintained at the second voltage;

in a light emission phase, applying a low level to the second scan line to turn off the third thin film transistor and the fourth thin film transistor; applying a high level to the light emission control signal line to turn on the second thin film transistor and the fifth thin film transistor n, and when the fifth thin film transistor is turned on, the voltage of the first electrode of the first thin film transistor is a voltage of the second power supply, and the gate voltage of the first thin film transistor is the second voltage, and a gate-source voltage of the first thin film transistor turns on the first thin film transistor, which generates a drive current to cause the light-emitting diode to emit light.

7. The method according to claim 6, wherein, when the pixel circuit comprises a second capacitor disposed between the anode of the light-emitting diode and the second electrode of the first thin film transistor, further comprising: in the data write phase, when the first thin film transistor is turned on, charging the second capacitor, and discharging the second capacitor after the second capacitor has been charged.

8. The method according to claim 6, wherein, when the pixel circuit comprises a sixth thin film transistor and a first scan line, is the method further comprising an initialization phase before the data write phase, and in the initialization phase, applying a high level to the first scan line to turn on the sixth thin film transistor as a diode, and setting a voltage of the second electrode of the first thin film transistor to a third voltage.

9. The method according to claim 8, wherein the second voltage is a sum of the first voltage and a threshold voltage of the first thin film transistor.

10. An organic light-emitting display, comprising:

a scan drive unit, a data drive unit, a light emission drive unit, N+1 scan lines, M data lines, and N light emission control signal lines; and an array of pixel circuits comprising N rows by M columns of pixel circuits, each of the pixel circuits being according to claim 5, wherein:

in the array of pixel circuits, the gates of the third thin film transistors and the fourth thin film transistors of a n-th row of the pixel circuits are connected with a (n+1)-th scan line, the second electrodes of the fourth thin film transistors of a m-th column of the pixel circuits are connected with a m-th data line, and the gates of the second thin film transistors and the fifth thin film transistors of the n-th row of the pixel circuits are connected with a n-th light emission control signal line, wherein $1 \leq n \leq N$, and $1 \leq m \leq M$;

the scan drive unit is configured to provide respective scan lines with a scan signal;

the data drive unit is configured to provide respective data lines with a data signal; and the light emission drive unit is configured to provide respective light emission control signal lines with a light emission control signal.

11. The organic light-emitting display according to claim 10, wherein: the scan drive unit is further configured to apply a high level to the (n+1)-th scan line in a data write phase; and to apply a low level to the (n+1)-th scan line in a light emission phase; the data drive unit is further configured to apply a high level to the m-th data line in the data write phase; and the light emission drive unit is further configured to apply a low level to the n-th light emission control signal line in the data write phase; and to apply a high level to the n-th light emission control signal line in the light emission phase.

12. The organic light-emitting display according to claim 11, wherein:

the scan drive unit is further configured to apply a high level to the n-th scan line and a low level on the (n+1)-th scan line in an initialization phase; and to apply a low level to the n-th scan line in the data write phase and the light emission phase; and the light emission drive unit is further configured to apply a low level to the n-th light emission control signal line in the initialization phase.

13. The pixel circuit according to claim 4, wherein the third thin film transistor and the fourth thin film transistor are P-type thin film transistors, and the first thin film transistor, the second thin film transistor, the fifth thin film transistor, and the sixth thin film transistor are N-type thin film transistors, the first signal line is the light emission control signal line, the first electrodes of the P-type thin film transistors are drains and the second electrodes of the P-type thin film transistors are sources, and the first electrodes of the N-type thin film transistors are sources and the second electrodes of the N-type thin film transistors are drains.

14. A method of driving the pixel circuit according to claim 13, comprising:

in a data write phase, applying a low level on the light emission control signal line to turn on the third thin film transistor, the fourth thin film transistor, and the first thin film transistor, and turn off the second thin film transistor and the fifth thin film transistor; applying a high level on the data line so that a voltage of the first electrode of the first thin film transistor is a first voltage; and when the first thin film transistor is turned on, the first capacitor starts to store charge until a gate voltage of the first thin film transistor drops to a second voltage and the first thin film transistor is turned off at this time, and after the first thin film transistor is turned off, the gate voltage of the first thin film transistor is maintained at the second voltage;

in a light emission phase, applying a high level to the light emission control signal line to turn off the third thin film transistor and the fourth thin film transistor, and turn on the second thin film transistor and the fifth thin film transistor, and when the fifth thin film transistor is turned on, the voltage of the first electrode of the first thin film transistor is the voltage of the second power supply, and the gate voltage of the first thin film transistor is the second voltage, and the gate-source voltage of the first thin film transistor turns on the first thin film transistor, which generates a drive current to cause the light-emitting diode to emit light.

15. The method according to claim 14, wherein when the pixel circuit further comprises a second capacitor disposed between the anode of the light-emitting diode and the second electrode of the first thin film transistor, the method further comprising: in the data write phase, when the first thin film transistor is turned on, charging the second capacitor, and discharging the second capacitor after the second capacitor has been charged.

16. The method according to claim 14, wherein when the pixel circuit further comprises a sixth thin film transistor and a first scan line, the method further comprising an initialization phase before the data write phase, and in the initialization phase, applying a high level to the first scan line to turn on the sixth thin film transistor as a diode, and setting a voltage of the second electrode of the first thin film transistor to a third voltage.

17. The method according to claim 16, wherein the second voltage is a sum of the first voltage and a threshold voltage of the first thin film transistor.

18. An organic light-emitting display, comprising:

a scan drive unit, a data drive unit, a light emission drive unit, N scan lines, M data lines, and N light emission control signal lines; and an array of pixel circuits comprising N rows by M columns of pixel circuits, each of the pixel circuits being according to claim 13, wherein:

in the array of pixel circuits, the gates of the third thin film transistors and the sixth thin film transistors of a n-th row of the pixel circuits are connected with a n-th light emission control signal line, the first electrodes of the sixth thin film transistors of a m-th column of the pixel circuits are connected with a m-th data line; and the gates of the second thin film transistors and the fifth thin film transistors of the n-th row of the pixel circuits are connected with the n-th light emission control signal line, wherein $1 \leq n \leq N$, and $1 \leq m \leq M$; the scan drive unit is configured to provide respective scan lines with a scan signal;

the data drive unit is configured to provide respective data lines with a data signal; and the light emission drive unit is configured to provide respective light emission control signal lines with a light emission control signal.

19. The organic light-emitting display according to claim 18, wherein: the data drive unit is further configured to apply a high level to the m-th data line in a data write phase; and the light emission drive unit is further configured to apply a low level to the n-th light emission control signal line in the data write phase; and to apply a high level n-th light emission control signal line in a light emission phase.

20. The organic light-emitting display according to claim 19, wherein: the scan drive unit is further configured to apply a high level to the n-th scan line in an initialization phase; and to apply a low level to the n-th scan line in the data write phase and the light emission phase.

* * * * *